US010973100B1

(12) United States Patent
Kanayama et al.

(10) Patent No.: US 10,973,100 B1
(45) Date of Patent: Apr. 6, 2021

(54) LED LUMINANCE CONTROL CIRCUIT, LED LUMINANCE CONTROL METHOD, AND LED LUMINANCE CONTROL PROGRAM

(71) Applicant: EIZO Corporation, Hakusan (JP)

(72) Inventors: Masumi Kanayama, Hakusan (JP); Kunio Kawamura, Hakusan (JP)

(73) Assignee: EIZO Corporation, Hakusan (JP)

( * ) Notice: Subject to any disclaimer, the term of this patent is extended or adjusted under 35 U.S.C. 154(b) by 0 days.

(21) Appl. No.: 16/958,381

(22) PCT Filed: Dec. 27, 2018

(86) PCT No.: PCT/JP2018/047994
§ 371 (c)(1),
(2) Date: Jun. 26, 2020

(87) PCT Pub. No.: WO2019/135380
PCT Pub. Date: Jul. 11, 2019

(30) Foreign Application Priority Data

Jan. 5, 2018 (JP) ..... JP2018-000470

(51) Int. Cl.
*H05B 45/10* (2020.01)
*H05B 45/34* (2020.01)
*H05B 45/345* (2020.01)

(52) U.S. Cl.
CPC ..... *H05B 45/34* (2020.01); *H05B 45/10* (2020.01); *H05B 45/345* (2020.01)

(58) Field of Classification Search
CPC ..... H05B 45/10; H05B 45/14; H05B 45/30; H05B 45/34; H05B 45/345
See application file for complete search history.

(56) References Cited

U.S. PATENT DOCUMENTS 10,827,588 B2 * 11/2020 Zhu ..... H05B 45/345
2007/0096561 A1 5/2007 Takeda et al.
(Continued)

FOREIGN PATENT DOCUMENTS

JP 2007-118847 A 5/2007
JP 2008-004707 A 1/2008
(Continued)

OTHER PUBLICATIONS

International Search Report dated Apr. 2, 2019 in corresponding International Application No. PCT/JP2018/047994; 3 pages.

*Primary Examiner* — Long Nguyen
(74) *Attorney, Agent, or Firm* — Maier & Maier, PLLC

(57) ABSTRACT

Provided is an ambient temperature estimating device, ambient temperature estimating method, program, and system that are able to realize both high robustness and high ambient temperature estimation accuracy. An ambient temperature estimating device includes a neural network, a temperature acquisition unit configured to acquire one or more temperature values inside the ambient temperature estimating device, and a neural network calculator configured to estimate an ambient temperature around the ambient temperature estimating device using the neural network. Input values inputted to the neural network by the neural network calculator include the temperature values acquired by the temperature acquisition unit and a heat source control value for controlling a heat source inside the ambient temperature estimating device.

6 Claims, 6 Drawing Sheets

(56) References Cited

U.S. PATENT DOCUMENTS

| | | | | |
|---|---|---|---|---|
| 2010/0219773 | A1 | 9/2010 | Nakai | |
| 2019/0230755 | A1 * | 7/2019 | Zhu | H05B 45/10 |

FOREIGN PATENT DOCUMENTS

| | | | |
|---|---|---|---|
| JP | 2009021314 | A | 1/2009 |
| JP | 2010-016265 | A | 1/2010 |
| JP | 2010-177531 | A | 8/2010 |

* cited by examiner

Fig. 3

| LED Luminance | LED Current Command Value (Value at DAC 31) Max 1023 C1 initial value | LED Voltage Command Value (Value at DAC 41) Max 1023 OC2 |
|---|---|---|
| 100% | 1023 | 900 |
| 90% | 921 | 879 |
| 80% | 818 | 868 |
| 70% | 716 | 858 |
| 60% | 614 | 845 |
| 50% | 512 | 832 |
| 40% | 409 | 819 |
| 30% | 307 | 805 |
| 20% | 205 | 788 |
| 10% | 102 | 775 |

LED LUMINANCE CONTROL CIRCUIT, LED LUMINANCE CONTROL METHOD, AND LED LUMINANCE CONTROL PROGRAM

FIELD

The present invention relates to an LED luminance control circuit, an LED luminance control method, and an LED luminance control program.

BACKGROUND

Light emitting diodes (LED) are used in various fields such as lighting equipment and display devices. The LED has a polarity like other general diodes, and is used by applying a positive voltage to the anode with respect to the cathode. While the voltage is low, the current does not increase even if the voltage increases, and no light is emitted. Then, when the voltage exceeds a certain value, the increase in the current with respect to the voltage becomes rapid, and light is emitted according to the amount of current. This voltage is called a forward drop voltage (hereinafter referred to as VF).

Patent Literature 1: Japanese Patent Application No. 2008-004707

SUMMARY

By the way, since the luminous efficiency of the LED has temperature dependence, the luminance will vary depending on the device temperature even if the flowing current is constant. Therefore, it can be said that the luminance of the LED becomes stable when the device temperature converges, and it takes a certain amount of time (see FIG. 6A). This is recognized as a significant problem particularly in medical displays and the like, in the case where stability of luminance is important.

On the other hand, in order to solve such a problem, a temperature sensor and a compensation circuit may be provided in the circuit. In this case, using the temperature information obtained from the temperature sensor, appropriate feedback can be given by the compensation circuit to stabilize the luminance of the LED early. Alternatively, since the VF of the LED has temperature dependence (see FIG. 6B), the luminance of the LED can be stabilized early by providing a detection circuit detecting the temperature dependence and an appropriate compensation circuit. However, in these methods, a temperature sensor or a detection circuit, and a compensation circuit are additionally required. Thus, not only it takes much cost, but also it may be even impossible to install them due to space constraints.

The present invention has been made in view of such circumstances, and is capable of suppressing both cost and installation space. The purpose of the present invention is to provide an LED luminance control circuit, LED luminance control method and an LED luminance control program which can stabilize the luminance of the LED.

According to an aspect of the present invention, provided is an LED control circuit comprising an LED voltage generating unit, an LED voltage control unit, and an LED current control unit, wherein the LED voltage generating unit is configured to apply a voltage to an LED based on an LED voltage command value input from the LED voltage control unit, the LED voltage control unit is configured to determine the LED voltage command value based on a cathode potential of the LED; and the LED current control unit is configured to control a value of current flowing through the LED based on the LED voltage command value.

In the LED control circuit according to this aspect, the value of current flowing through the LED is controlled, based on the LED voltage command value setting the output voltage of the power supply (LED voltage generation unit), which applies a voltage to the LED, to an appropriate value which can flow the target current. With realizing such a configuration, a temperature sensor and a compensation circuit are not required. That is, both the cost and the installation space can be suppressed, and the luminance of the LED can be stabilized early.

Hereinafter, various embodiments of the present invention will be described. The embodiments described below can be combined with each other.

Preferably, the LED voltage control unit sets a value obtained by performing a predetermined calculation on the value of current as a target value of the cathode potential, and determines the LED voltage command value based on a comparison result of the target value and an actual measured value of the cathode potential.

Preferably, a storage unit configured to store a look-up table in which a correspondence relationship between luminance and the LED voltage command value is predetermined, wherein the LED current control unit controls the value of current based on a desired luminance, an LED voltage command value in the lookup table corresponding to the desired luminance, and an actual LED voltage command value.

Preferably, provided is a device comprising an LED, and the circuit described above, wherein luminance of the LED is controlled by the circuit.

Preferably, the device is any one of a lighting device, a display device, an image processing device, or a medical image device.

According to another aspect of the invention, provided is a method for controlling LED luminance comprising, controlling a value of current flowing through an LED based on an LED voltage command value input into a power supply applying a voltage to the LED from a controller of the power supply, and determining the LED voltage command value based on a cathode potential.

In the LED luminance control method according to this aspect, a value of current flowing through an LED based on an LED voltage command value input into a power supply applying a voltage to the LED from a controller of the power supply. A temperature sensor or a compensation circuit is not required to implement such a method. That is, both the cost and the installation space can be suppressed, and the luminance of the LED can be stabilized early.

According to another aspect of the invention, provided is a program for causing a computer to perform a predetermined function comprising controlling the value of current flowing through an LED based on an LED voltage command value input into a power supply applying a voltage to the LED from a controller of the power supply, and determining the LED voltage command value based on a cathode potential.

In the LED luminance control program according to this aspect, a value of current flowing through an LED based on an LED voltage command value input into a power supply applying a voltage to the LED from a controller of the power supply. A temperature sensor or a compensation circuit is not required to execute this program. That is, both the cost and the installation space can be suppressed, and the luminance of the LED can be stabilized early.

BRIEF DESCRIPTION

FIG. 3 is an example of lookup table defining the correspondence relationship between the LED luminance, the LED current command value, and the target LED voltage command value.

DETAILED DESCRIPTION

Hereinafter, embodiments of the present invention will be described in detail with reference to the drawings. In particular, in the present specification, a "unit" includes, for example, a combination of hardware resources implemented by a circuit in a broad sense and information process by software which can be specifically realized by these hardware resources. Further, in the present embodiment, various kinds of information are handled, but all this information is represented as a bit group of binary numbers composed of 0 or 1 by the level of the signal value, and communication or operation is performed on a circuit in a broad sense.

The circuit in a broad sense is realized by appropriately combining at least a circuit, a circuitry, a processor, a memory, and the like. That is, an application-specific integrated circuit (ASIC), a programmable logic device (for example, a simple programmable logic device (SPLD), a complex programmable logic device (SPLD), a field programmable gate array (FPGA)) and the like, may be included.

1. ENTIRE STRUCTURE

In this section, each component of the LED luminance control circuit 1 will be described.

Figure 1:
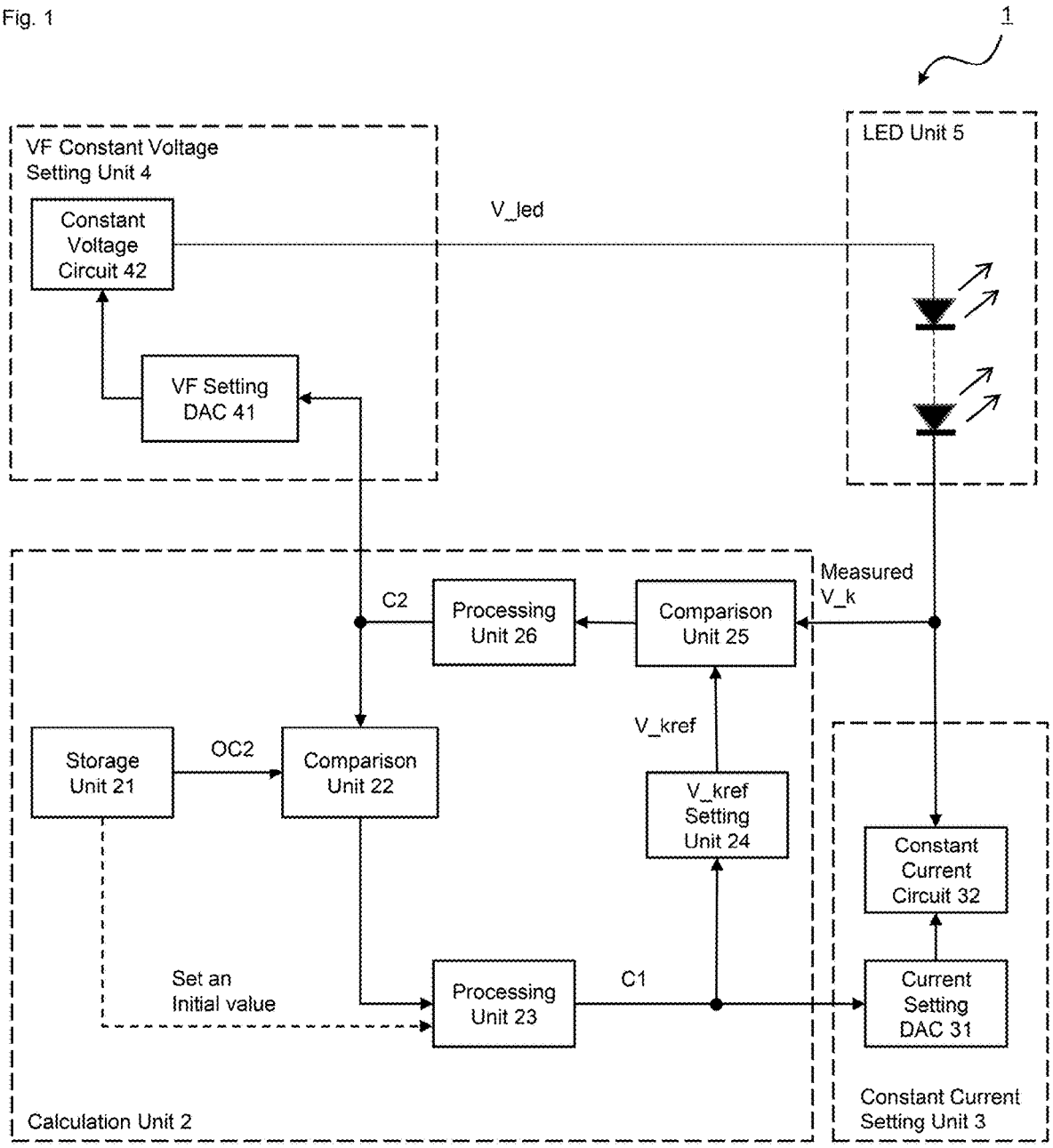
FIG. 1 is a functional block diagram of an LED luminance control circuit according to an embodiment of the present invention.

FIG. 1 is a functional block diagram of an LED luminance control circuit 1 according to the embodiment of the present invention. The LED luminance control circuit 1 includes a calculation unit 2 (an example of an "LED voltage control unit" and a "controller"), a constant current setting unit 3, a VF constant voltage setting unit 4 (an example of an "LED voltage generating unit" and a "power supply") and an LED unit 5. The calculation unit 2 and the constant current setting unit 3 are an example of those realizing function as an "LED current control unit". Hereinafter, each of the configuration elements 2 to 5 will be described in detail.

1.1 Calculation Unit 2

The calculation unit 2 includes a storage unit 21, a comparison unit 22, a processing unit 23, a V_kref setting unit 24, a comparison unit 25, and a processing unit 26.

<Storage Unit 21>

The storage unit 21 stores a lookup table T described later. The lookup table T predetermines a correspondence relationship between luminance to be set, an LED voltage command value C2 (hereinafter, simply referred to as command value C2) input into the VF constant voltage setting unit 4 from a processing unit 26, and an LED current command value C1 (hereinafter, simply referred to as command value C1) input into the constant current setting unit 3 from a processing unit 23. This will be described in detail in Section 2.

In addition, the storage unit 21 stores a program performed by the processing unit 23 and various kinds of information (for example, a target luminance value set by the user or the like). This can be implemented as a storage device such as a solid state drive (SSD) and a hard disk drive (HDD). The storage unit 21 can also be implemented as a memory such as a random access memory (RAM) storing temporarily necessary information (arguments, arrays, etc.) related to program operations. Also, a combination of these may be used.

<Comparison Unit 22>

The comparison unit 22 compares the command value C2 input from the processing unit 26 with the lookup table T in the storage unit 21, and feeds back the comparison result to the processing unit 23. More specifically, the comparison unit 22 adjusts the command value C1 output from the processing unit 23 in order to adjust an LED current value I_led so that the target command value OC2 obtained from the lookup table T and the command value C2 are equal.

<Processing Unit 23>

The processing unit 23 outputs, as an initial setting, a command value C1 of an initial current setting value corresponding to the luminance to be set to a current setting DAC 31. Further, the processing unit 23 outputs the command value C1 adjusted by the comparison unit 22 to the current setting DAC 31. At the same time, the processing unit 23 also outputs the adjusted command value C1 to the V_kref setting unit 24.

<V_Kref Setting Unit 24>

The V_kref setting unit 24 receives the command value C1 from the processing unit 23. Then, a target value V_kref of the cathode potential is calculated by converting the command value C1 into an LED current value I_led and by performing a predetermined calculation (for example, shown in the equation (1) below). Then, the calculated target value V_kref of the cathode potential is output to the comparison unit 25.

$$V_kref = I_led \times R_s + V_ds \quad (1)$$

Figure 2:
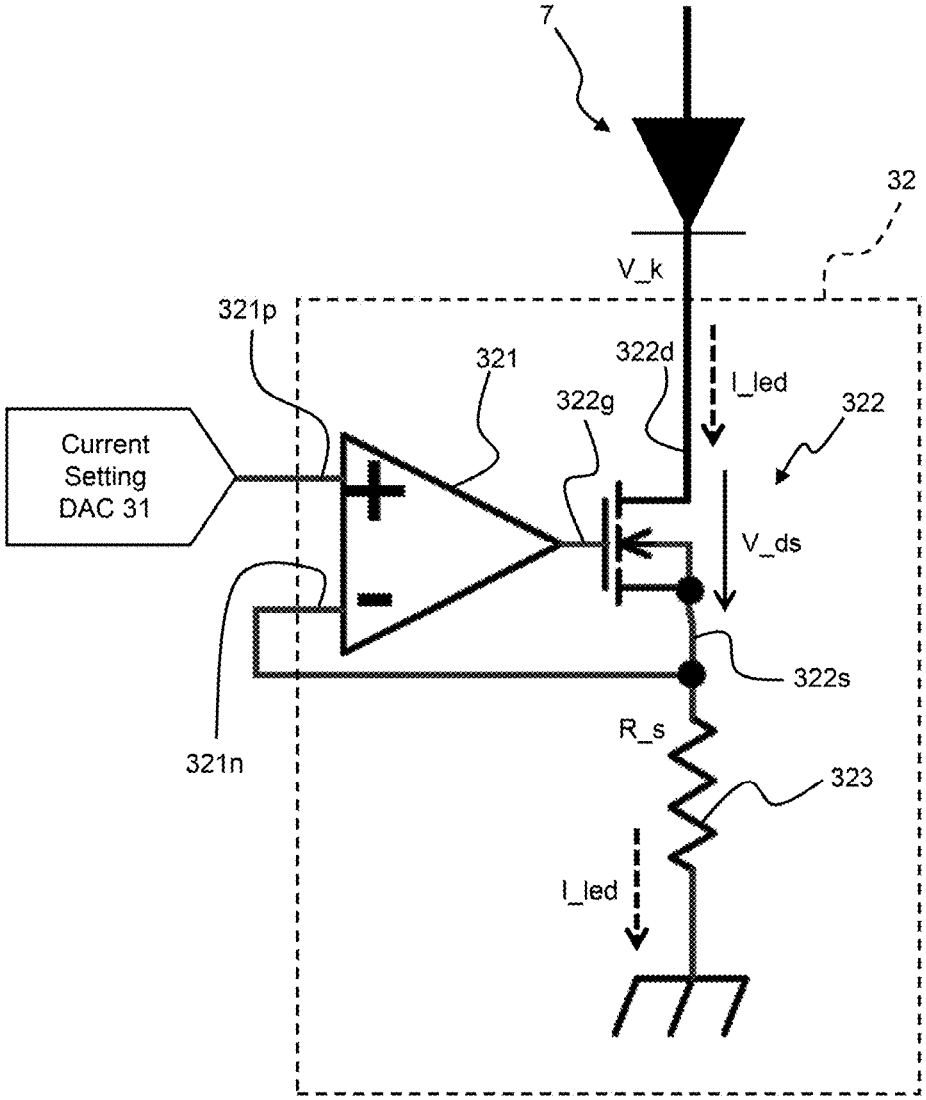
FIG. 2 is a circuit diagram of constant current circuit.

Here, V_ds in the equation (1) is a voltage applied between the drain 322*d* and the source 322*s* in the N-type MOS-FET 322 in FIG. 2, and is a fluctuation value defined by the resistance value of the N-type MOS-FET 322 when the MOS-FET 322 is on, and by the LED current value I_led.

<Comparison Unit 25>

The comparison unit 25 compares the target value V_kref of the cathode potential input from the V_kref setting unit 24 with an actual measured value V_k of the cathode potential, and adjusts the command value C2 output from the processing unit 26 so that V_kref and V_k become equal.

<Processing Unit 26>

The processing unit 26 outputs the command value C2 adjusted by the comparison unit 25 to the VF setting DAC 41 of the VF constant voltage setting unit 4. The VF setting DAC 41 outputs a feedback voltage to a constant voltage circuit 42 based on the input command value C2, and thereby obtains a desired LED voltage value V_led. Note that the processing unit 26 also outputs the command value C2 to the comparison unit 22. As described in the section of the comparison unit 22, this command value C2 is compared with the target command value OC2 in the lookup table T of the storage unit 21, and the command value C1 is adjusted as a feedback. The command value C2 will be described in detail later.

1.2 Constant Current Setting Unit 3

The constant current setting unit 3 has a current setting DAC 31 and a constant current circuit 32.

<Current Setting DAC 31>

The current setting DAC 31 outputs the voltage to the constant current circuit 32 based on the command value C1 output from the processing unit 23 of the calculation unit 2 to set the current of the LED current value I_led (hereinafter simply referred to as the current I_led) supplied to the LED unit 5. The set current I_led is realized by the constant current circuit 32 described below.

<Constant Current Circuit 32>

FIG. 2 shows a circuit diagram of the constant current circuit 32. As shown in FIG. 2, the constant current circuit 32 includes an operational amplifier 321, an N-type MOSFET 322, and a resistor 323 (resistance value: R_s).

In the constant current circuit 32 shown in FIG. 2, the drain 322*d* of the N-type MOS-PET 322 is connected to the cathode side of the LED unit 5. Then, the current I_led flows from the LED unit 5 into the drain 322*d*. In this constant current circuit 32, the current I_led ideally does not flow to the gate 322*g* but all to the source 322*s*. The constant current circuit 32 is grounded through the resistor 323. Therefore, a potential of I_led×R_s is generated on the upper side of the resistor 323, that is, the negative input terminal 321*n* of the operational amplifier 321. The circuit operates so that this potential is equal to the potential of the positive input terminal 321*p* of the operational amplifier 321. That is, in the constant current setting unit 3, the current setting DAC 31 is connected to the positive input terminal 321*p* of the operational amplifier 321, and the current I_led can be controlled according to the potential value input from the positive input terminal 321*p*.

1.3 VF Constant Voltage Setting Unit 4

The VF constant voltage setting unit 4 has a VF setting DAC 41 and a constant voltage circuit 42.

<VF Setting DAC 41>

The VF setting DAC 41 receives the command value C2 output from the processing unit 26 of the calculation unit 2, and outputs the output voltage corresponding to the command value C2 to the feedback circuit of the constant voltage circuit 42. As a result, the output voltage of connected constant voltage is adjusted so that the desired LED voltage value V_led is realized.

The output voltage of the constant voltage circuit corresponds to the LED voltage VF in the LED unit 5. As described above, in order to flow a desired constant current through the LED, it is necessary to apply the forward drop voltage VF or higher. However, VF is temperature-dependent and is not constant. Therefore, the current flowing through the LED is monitored so as to be in a desired constant current state, and the constant voltage circuit is fed back to indirectly control the constant voltage of VF. More specifically, the comparison unit 25 adjusts the command value C2 which is the output of the processing unit 26, and feeds back to the constant voltage circuit until the actually measured cathode potential V_k becomes equal to the target value V_kref. At the moment they become equal, the target constant current flows through the LED, and the output voltage of the constant voltage circuit is set to the required VF under the element temperature.

<Constant Voltage Circuit 42>

The constant voltage circuit 42 is a circuit for stably outputting the VF voltage of the LED. As described above, the constant voltage circuit 42 is connected to the VF setting DAC 41, the feedback amount is adjusted by the output voltage from the VF setting DAC 41, and the constant voltage circuit 42 is controlled to generate the desired LED voltage value V_led. The output voltage is applied to the LED unit 5 as an anode voltage.

1.4 LED Unit 5

The LED unit 5 is a module including a plurality of LEDs, and for example, can be used as a backlight of a display device (LED display). The voltage of the LED voltage value V_led is applied to the anode side, and the LED in the LED unit 5 emits light. At this time, a voltage VF is generated in the LED unit 5, and the current I_led flows. The luminance of the LED depends on the LED current value I_led, and the LED luminance control circuit 1 according to the present embodiment controls the luminance of the LED by controlling the LED current value I_led.

2. COMMAND VALUE C2 AND LOOKUP TABLE T

In this section, the command value C2 which is the setting value of the VF setting DAC 41 and is the basis of the setting of the LED voltage value V_led by the constant voltage circuit 42, and the lookup table T stored in the storage unit 21 of the calculation unit 2 will be described in detail.

The command value C2 is a feedback value for voltage setting input to the VF constant voltage setting unit 4, and the LED voltage value V_led is determined by the command value C2. In the LED luminance control circuit 1 according to the present embodiment, assuming that a certain luminance is set, the current value of the constant current setting unit 3 is set, the command value C2 is fed back using the cathode potential, and the target value V_kref of the cathode potential and the measured value V_k become equal.

At this moment, the target setting current flows through the LED, and the LED voltage value V_led is set to a value that allows the setting current to flow under the element temperature at this timing. Even if the current is constant, the LED voltage value V_led is not constant because the required VF voltage value changes depending on the element temperature due to the characteristics of the LED. That is, the set LED voltage value V_led relatively represents the element temperature, and it can be said that the command value C2 determining the voltage is also set depending on the element temperature.

Next, the lookup table T will be described in detail. The lookup table T stored in the storage unit 21 defines a correspondence relationship between the luminance, the LED current value I_led (that is, the command value C1), and the LED voltage value V_led (that is, the target command value OC2) in the temperature equilibrium state of the LED. FIG. 3 shows an example thereof.

As described in the section of Technical Problem above, since both the luminance of the LED and the VF of the LED have temperature dependency, it can be said that the luminance and the VF of the LED are correlated with each other. And the luminance of the LED directly depends on the LED current value I_led. Therefore, as shown in FIG. 3, the relationship of the luminance, the LED current value (command value C1), and the target LED voltage value (target command value OC2) are defined in one lookup table.

With such a configuration, the comparison unit 22 in the calculation unit 2 compares the command value C2 acquired from the processing unit 26 with the target command value OC2 in the table T, and can control the LED current value I_led so that these values become equal.

By the constant current feedback of the comparison unit 25 using the cathode potential, the comparison unit 22 further applies feedback using the target command value OC2 in the temperature equilibrium state to the command value C2 set depending on the element temperature. As a result, the set current value can be adjusted and the luminance temperature correction can be performed. That is, by using the LED luminance control circuit 1 according to the present embodiment, the device temperature coefficient of the LED can be fed back to the current control, and the LED can emit light with stable luminance early.

3. PROCESS FLOW OF LED LUMINANCE CONTROL CIRCUIT 1

In this section, the flow of LED luminance control using the LED luminance control circuit 1 according to the present embodiment will be described. Here, it is assumed that the LED unit 5 is a backlight of a display device, and the LED luminance control circuit 1 is embedded in the display device.

[Start]

(Step S1)

The power of the display device is turned on, and the LED in the LED unit 5 start emitting light. At this time, the LED current value corresponding to the desired luminance is previously stored in the storage unit 21 of the calculation unit 2 as an initial value. The processing unit 23 in the calculation unit 2 outputs the initial value as the command value C1 to the constant current setting unit 3. The processing unit 23 also outputs the command value C1 to the V_kref setting unit 24 (following to step S2).

(Step S2)

In the constant current setting unit 3, the current setting DAC 31 outputs a voltage corresponding to the command value C1 (initial value of LED current value) received from the processing unit 23. Then, the constant current circuit 32 starts the constant current operation. Here feedback to VF starts at the same time when the current starts flowing (following to step S3).

The V_kref setting unit 24 sets the target value V_kref of the cathode potential using the command value C1 received from the processing unit 23 and the equation (1) described in Section 1.1 (following to step S4).

(Step S4)

The comparison unit 25 compares the target value V_kref with the actually measured value V_k about the cathode potential. If the actually measured value V_k of the cathode potential and the target value V_kref of the cathode potential are equal, it means that the LED voltage value V_led become capable of flowing the current to be set. Further, the comparison unit 25 uses the comparison result to control the value of the command value C2 output from the processing unit 26 to the VF setting DAC 41. The processing unit 26 also outputs the command value C2 to the comparison unit 22. Then, the VF setting DAC 41 outputs the feedback voltage corresponding to the command value C2 to the feedback circuit of the constant voltage circuit 42, and the constant voltage circuit 42 generates the LED voltage based on the feedback voltage (following to step S5).

(Step S5)

The comparison unit 22 compares the value of the command value C2 in step S4 with the lookup table T stored in the storage unit 21. Then, the comparison unit 22 adjusts the value of the command value C1 to be output to the current setting DAC 31 so that the target command value OC2 in the lookup table T and the actual command value C2 are equal. The adjusted command value C1 is output to the current setting DAC 31 and the V_kref setting unit 24 by the processing unit 23. That is, the LED current value I_led set by the current setting DAC 31 is updated, and the LED voltage value V_led set by the V_kref setting unit 24 is also updated (return to step S2).

[End]

In this way, by repeating steps S2 to S5 thereafter, it is possible to make the LED emit light at a temperature equilibrium early. More specifically, the following control will be performed.

Figure 6A:
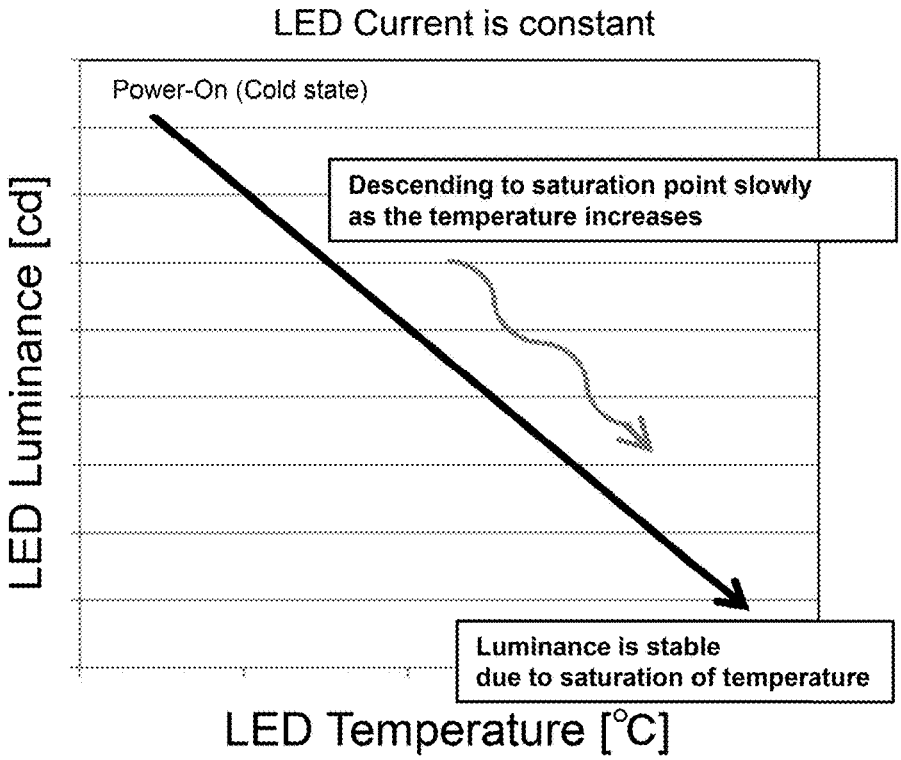
FIG. 6A is a graph of LED temperature versus LED luminance.
Figure 6B:
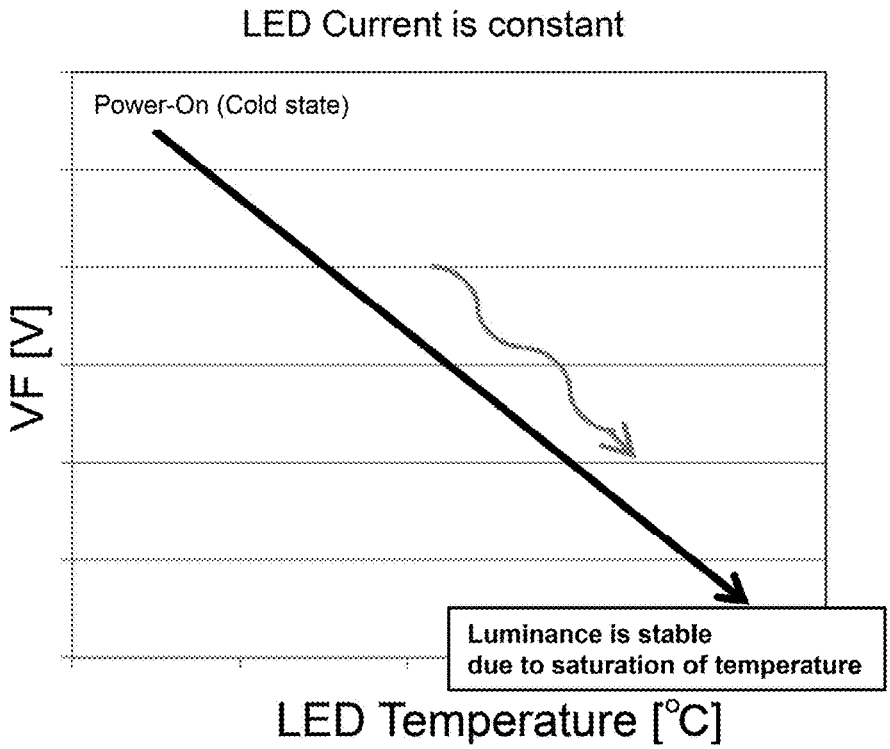
FIG. 6B is a graph of LED temperature versus VF.

First, there is considered a case where a constant current circuit (that is, a constant current value) is used to make LED emit light without any correction. Immediately after the power of the display device is turned on, the device temperature is in a cold state, and the luminance of the LED unit 5 becomes high as shown in FIG. 6A. As the device temperature rises over time, the luminance of the LED unit 5 becomes low. Then, the luminance of the LED unit 5 finally becomes stable, when the device temperature is saturated.

Next, there is considered a case where the LED luminance control circuit according to the present embodiment is used to make the LED emit light. Since the behavior without correction is known as described above, the LED current value I_led may be controlled over time with correction. That is, when the temperature of the LED element is low, the LED current value I_led is controlled to be relatively small at first, and the LED current value I_led is controlled to increase over time (i.e. as device temperature rise). For example, when the LED element is turned on at a low temperature and the constant current state continues, the VF (that is, C2) which needs to be applied decreases as the LED element heats up. So, the comparison unit 22 applies feedback to increase the setting current to approach the target command value OC2. Therefore, the set current is controlled to be small at first and gradually increase.

Figure 4:
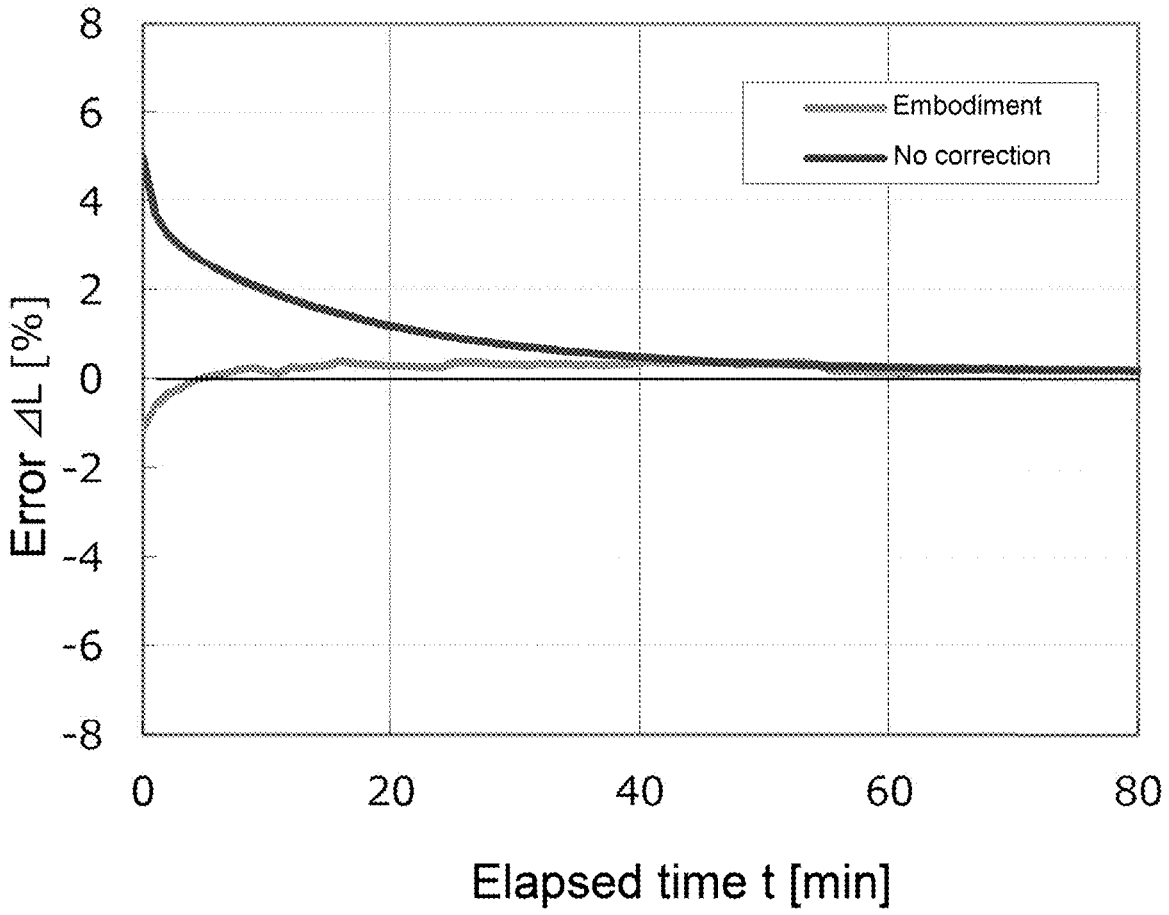
FIG. 4 is a graph showing the temporal change of the luminance error, in which the effect of the embodiment can be confirmed.
Figure 5:
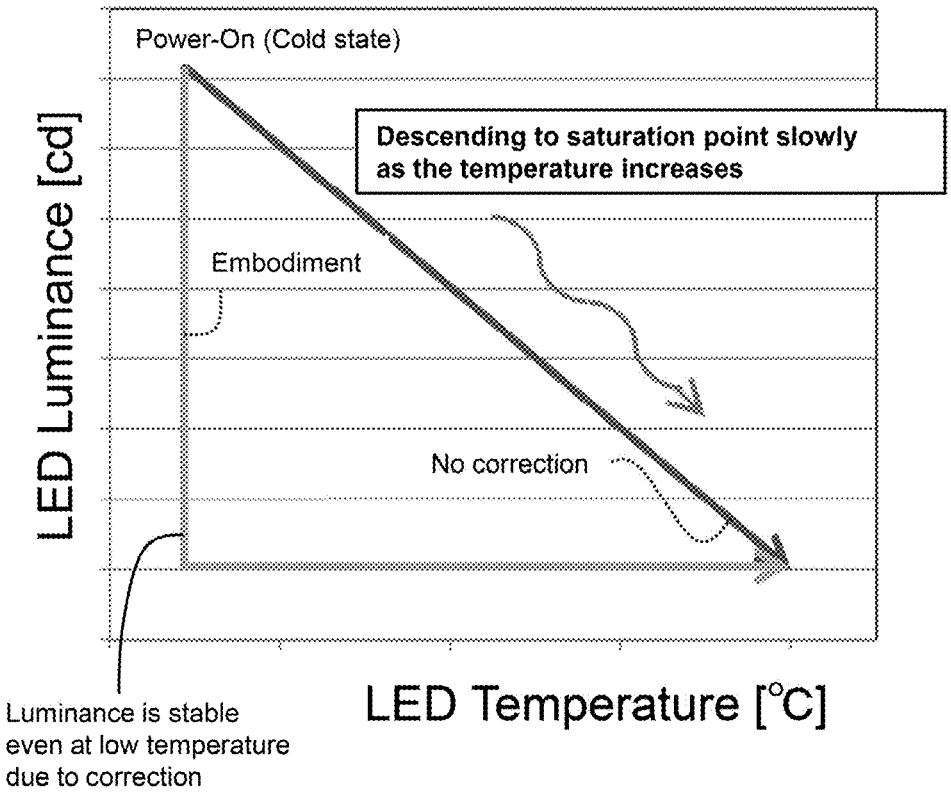
FIG. 5 is a graph of LED temperature versus LED luminance in which the effects of the embodiment can be confirmed.

Here, for reference, the relationship between the error ΔL [%] from the stable luminance of the LED and the elapsed time t [min] is shown in FIG. 4. When the LED luminance control circuit 1 according to this embodiment is used, ΔL converges to less than 0.3% (stable state) in about one minute after the start, while it takes about 60 minutes for ΔL to converge to a stable state in the conventional technique (i.e. no correction). This result is shown in FIG. 5 as a graph of LED temperature versus LED luminance.

4. MODIFICATION

The LED luminance control method according to the present embodiment described above can also be implemented in the following examples.

First, the target LED voltage command value (target command value OC2) corresponding to the LED luminance may be calculated each time without using the lookup table T.

Second, it should be noted that a device including the LED luminance control circuit 1 according to the present embodiment may be, for example, a display device (LED display), a lighting device (LED lighting), an image processing device, a medical image device, or the like.

Third, it is also possible to provide an LED luminance control program for causing a computer to realize a predetermined function, wherein the value of current flowing through the LED is controlled, based on a command value input to a power supply from a controller of the power supply which applies a voltage to the LED. Further, the program can be provided as a computer-readable non-transitory storage medium which implements the functions of the program. Further, such a program can be distributed via the Internet or the like. Further, the respective units configuring the LED luminance control circuit 1 may be included in the same housing or may be distributed and arranged in a plurality of housings.

5. CONCLUSION

As described above, according to the present embodiment, both the cost and the installation space can be suppressed, and the LED luminance control circuit, the LED luminance control method, and the LED luminance control program which can stabilize the luminance of the LED early can be provided.

Although various embodiments according to the present invention have been described, these are presented as examples and are not intended to limit the scope of the invention. The novel embodiment can be implemented in various other forms, and various omissions, replacements, and changes can be made without departing from the gist of the invention. The embodiment and its modifications are included in the scope and gist of the invention and are also included in the invention described in the embodiments and the scope equivalent thereto.

1: LED luminance control circuit
2: calculation unit
21: storage unit
22: comparison unit
23: processing unit
24: V_kref setting unit
25: comparison unit
26: processing unit
3: constant current setting unit
31: current setting DAC
32: constant current circuit
321: operational amplifier
321*n*: negative input terminal
321*p*: positive input terminal
322: MOS-FET
322*d*: drain
322*g*: gate
322*s*: source
323: resistor
4: VF constant voltage setting unit
41: VF setting DAC
42: constant voltage circuit
5: LED unit

The invention claimed is:

1. An LED control circuit comprising an LED voltage generating unit, an LED voltage control unit, an LED current control unit, and a storage unit wherein the LED voltage generating unit is configured to apply a voltage to an LED based on an LED voltage command value input from the LED voltage control unit, the LED voltage control unit is configured to determine the LED voltage command value based on a cathode potential of the LED, the LED current control unit is configured to control a value of current flowing through the LED based on the LED voltage command value, the storage unit is configured to store a look-up table in which a correspondence relationship between luminance and the LED voltage command value is predetermined, and the LED current control unit controls the value of current based on a desired luminance, the LED voltage command value in the lookup table corresponding to the desired luminance, and an actual LED voltage command value.

2. The circuit of claim 1, wherein the LED voltage control unit sets a value obtained by performing a predetermined calculation on the value of current as a target value of the cathode potential, and determines the LED voltage command value based on a comparison result of the target value and an actual measured value of the cathode potential.

3. A device comprising:

an LED; and the circuit of claim 1, wherein luminance of the LED is controlled by the circuit.

4. The device of claim 3, wherein the device is any one of a lighting device, a display device, an image processing device, or a medical image device.

5. A method for controlling LED luminance comprising:

controlling a value of current flowing through an LED based on an LED voltage command value input into a power supply applying a voltage to the LED from a controller of the power supply, determining the LED voltage command value based on a cathode potential, storing a look-up table in which a correspondence relationship between luminance and the LED voltage command value is predetermined, and controlling the value of current based on a desired luminance, the LED voltage command value in the lookup table corresponding to the desired luminance, and an actual LED voltage command value.

6. A non-transitory computer-readable storage medium storing a program for causing a computer to perform a predetermined function comprising;

controlling the value of current flowing through an LED based on an LED voltage command value input into a power supply applying a voltage to the LED from a controller of the power supply, determining the LED voltage command value based on a cathode potential, storing a look-up table in which a correspondence relationship between luminance and the LED voltage command value is predetermined, and controlling the value of current based on a desired luminance, the LED voltage command value in the lookup table corresponding to the desired luminance, and an actual LED voltage, command value.

* * * * *